US007798745B2

(12) United States Patent
Hall et al.

(10) Patent No.: US 7,798,745 B2
(45) **Date of Patent: *Sep. 21, 2010**

(54) NOZZLE FOR A PAVEMENT RECONDITIONING MACHINE

(76) Inventors: David R. Hall, 2185 S. Larsen Pkwy., Provo, UT (US) 84606; David Wahlquist, 2185 S. Larsen Pkwy., Provo, UT (US) 84606; Thomas Morris, 2185 S. Larsen Pkwy., Provo, UT (US) 84606

( * ) Notice: Subject to any disclaimer, the term of this patent is extended or adjusted under 35 U.S.C. 154(b) by 422 days.

This patent is subject to a terminal disclaimer.

(21) Appl. No.: 11/841,077

(22) Filed: Aug. 20, 2007

(65) Prior Publication Data

US 2009/0052986 A1 Feb. 26, 2009

(51) Int. Cl.
*E01C 23/16* (2006.01)
*E01C 19/12* (2006.01)

(52) U.S. Cl. ..... 404/94; 404/101

(58) Field of Classification Search ..... 404/89, 404/91, 94, 102; 299/17, 34.05, 81.2; 239/DIG. 19, 239/601, 589, 592, 597, 591
See application file for complete search history.

(56) References Cited

U.S. PATENT DOCUMENTS 1,898,158 A 2/1933 Winkle
1,931,792 A * 10/1933 Giordano ..... 239/491
2,039,078 A 4/1936 Hertwig
1,887,341 A 11/1936 Venable
2,098,895 A 11/1937 Velten
2,413,908 A * 1/1947 Chester ..... 404/92
2,633,782 A 4/1953 Clement
2,893,299 A 7/1959 Moir
2,908,206 A 10/1959 Melanson
2,938,438 A 5/1960 Hamilton
3,075,436 A 1/1963 McRae
3,094,047 A * 6/1963 Patton ..... 404/94
3,361,042 A 1/1968 Cutler
3,598,446 A * 8/1971 Hatcher ..... 299/39.2
3,732,023 A 5/1973 Rank
3,817,644 A 6/1974 Matson
3,865,098 A * 2/1975 Cutler ..... 126/271.2 A
3,970,404 A 7/1976 Benedetti
3,989,401 A 11/1976 Moench
4,018,540 A 4/1977 Jackson
RE29,496 E * 12/1977 Dydzyk ..... 366/25
4,074,858 A * 2/1978 Burns et al. ..... 299/17
4,081,200 A * 3/1978 Cheung ..... 299/17
4,104,736 A 8/1978 Mendenhall
4,124,325 A 11/1978 Cutler
4,127,351 A 11/1978 Vural
4,172,679 A 10/1979 Wirtgen (Continued)

*Primary Examiner*—Thomas B Will
*Assistant Examiner*—Abigail A Risic
(74) *Attorney, Agent, or Firm*—Tyson J. Wilde

(57) ABSTRACT

In one aspect of the invention, an apparatus for reconditioning a paved surface, has a vehicle adapted to traverse the paved surface. The vehicle has a manifold with a plurality of high pressure nozzles adapted to indent the paved surface. At least one nozzle is formed in a nozzle body with a distal end having a hard material with a hardness of at least 2,000 HK. The at least one nozzle is also in fluid communication with a fluid reservoir through a fluid pathway. The apparatus has a pressurizing mechanism and a heating mechanism for pressurizing and heating fluid in the fluid pathway.

19 Claims, 9 Drawing Sheets

U.S. PATENT DOCUMENTS 4,195,946 A 4/1980 Swisher
4,215,949 A 8/1980 Gabriel
4,261,230 A 4/1981 Sindelar
4,261,669 A 4/1981 Edo
4,313,690 A 2/1982 Hojbjerg
4,335,975 A 6/1982 Schoelkopf
4,347,016 A 8/1982 Sindelar
4,407,605 A 10/1983 Wirtgen
4,473,320 A 9/1984 Register
4,534,674 A 8/1985 Cutler
4,592,507 A * 6/1986 Benedict ..... 239/172
4,594,022 A 6/1986 Jeppson
4,637,656 A * 1/1987 Medeot ..... 299/1.5
4,668,017 A 5/1987 Peterson
4,676,689 A 6/1987 Yant
4,692,350 A 9/1987 Clarke
4,753,549 A * 6/1988 Shook et al. ..... 404/75
4,784,518 A 11/1988 Cutler
4,793,730 A 12/1988 Butch
4,968,101 A 11/1990 Bossow
5,026,205 A 6/1991 Gorski
5,131,788 A 7/1992 Hulicsko
5,279,500 A * 1/1994 Perrin et al. ..... 404/75
5,361,993 A * 11/1994 Andersson ..... 239/752
5,366,320 A 11/1994 Hanlon
5,556,225 A 9/1996 Marino
5,765,926 A 6/1998 Knapp
5,791,814 A 8/1998 Wiley
5,921,478 A * 7/1999 Kamiwano et al. ..... 241/5
5,947,636 A 9/1999 Mara
5,947,638 A 9/1999 Heims
5,951,561 A 9/1999 Pepper
6,122,601 A 9/2000 Swanson
6,152,356 A * 11/2000 Minden ..... 299/17
6,158,920 A 12/2000 Malot
6,287,048 B1 9/2001 Hollon
6,363,625 B1 * 4/2002 Niemi ..... 34/136
6,371,689 B1 4/2002 Wiley
6,443,661 B1 * 9/2002 Wathen ..... 405/262
6,551,018 B2 4/2003 Baker
6,577,141 B2 6/2003 Gandrud
6,623,207 B2 9/2003 Grubba
6,769,836 B2 8/2004 Llyod
6,799,922 B2 10/2004 Smith
6,846,354 B2 1/2005 Larsen
7,429,146 B2 * 9/2008 Hall et al. ..... 404/93
7,513,508 B2 * 4/2009 Malit ..... 280/5.518
2006/0032095 A1 * 2/2006 Buckner ..... 37/304
2006/0127180 A1 * 6/2006 Hall et al. ..... 404/94
2008/0029924 A1 * 2/2008 Maezawa et al. ..... 264/117
2008/0191066 A1 * 8/2008 Jernigan et al. ..... 239/587.1

* cited by examiner

NOZZLE FOR A PAVEMENT RECONDITIONING MACHINE

BACKGROUND OF THE INVENTION

Modern road surfaces typically comprise a combination of aggregate materials and binding agents processed and applied to form a smooth paved surface. The type and quality of the pavement components used, and the manner in which the pavement components are implemented or combined, may affect the durability of the paved surface. Even where a paved surface is quite durable, however, temperature fluctuations, weather, and vehicular traffic over a paved surface may result in cracks and other surface or sub-surface irregularities over time. Road salts and other corrosive chemicals applied to the paved surface, as well as accumulation of water in surface cracks, may accelerate pavement deterioration.

U.S. Pat. No. 4,592,507 which is herein incorporated by reference for all that it contains, discloses an apparatus and a method for coating a road surface with bitumen binder material. The apparatus includes distribution conduit members for conducting bitumen material in a fluid state from a continuous source thereof and distribution conduit members for conducting gas, preferably steam, from a continuous source thereof. Pluralities of mixer housings are joined to the conduit members and receive bitumen binder material and gas. The apparatus is carried by a vehicle which travels over a road surface. The bitumen binder material and the gas are mixed and sprayed upon the road surface as the vehicle travels over the road surface.

U.S. Pat. No. 5,324,136 which is herein incorporated by reference for all that it contains, discloses an apparatus for spreading a fluid or similar substance, especially a bonding emulsion for road asphalt onto the surface of a road, comprising, on a movable vehicle, at least one spreading boom, along which the spreading is carried out at least partially, said boom being associated with at least one ejection nozzle and with a feed circuit and being capable of being displaced relative to the movable vehicle transversely to the direction of movement of the latter, and is associated with motor means intended for driving it in displacement, during spreading, in a to-and-fro movement. The machine of the finisher type comprises such an apparatus.

BRIEF SUMMARY OF THE INVENTION

In one aspect of the invention, an apparatus for reconditioning a paved surface, having a vehicle adapted to traverse the paved surface. The vehicle has a manifold with a plurality of high pressure nozzles adapted to indent the paved surface. At least one nozzle is formed in a nozzle body with a distal end having a hard material with a hardness of at least 2,000 HK. The at least one nozzle is also in fluid communication with a fluid reservoir through a fluid pathway. The apparatus has a pressurizing mechanism and a heating mechanism for pressurizing and heating fluid in the fluid pathway.

The distal end may be pointed, rounded, flat, polygonal, or any combination thereof. The distal end of the nozzle body may comprise a sloped face adapted to contact the surface. The hard material may be selected from the group consisting of diamond, monocrystalline diamond, polycrystalline diamond, sintered diamond, chemical deposited diamond, physically deposited diamond, natural diamond, infiltrated diamond, layered diamond, thermally stable diamond, silicon bonded diamond, metal bonded diamond, cubic boron nitride, silicon carbide, diamond impregnated matrix, diamond impregnated carbide, and combinations thereof.

The manifold may further comprise a projection proximate and rearward of the at least one nozzle body, the projection being adapted to maintain pressure on the paved surface. The projection may comprise a plurality of diamond segments. The manifold may further comprise a projection proximate and forward of the nozzle body, the projection being adapted to prevent chipping of the paved surface. The manifold may be in electrical communication with electronic equipment. The manifold may comprise a depressurization chamber rearward of the projection.

The nozzle body may be vertically translatable. The nozzle body may be hydraulically translated. The nozzle body may comprise a wedge shape with a wider portion of the wedge shape rearward of a narrower portion of the wedge shape. The nozzle body may comprise a radiused forward edge on the distal end. The nozzle body may be adapted to indent up to an inch into the paved surface. The nozzle body may be formed from a carbide substrate bonded to diamond. The diamond may comprise a thickness of at least 0.100 inch. The nozzle may be formed by electric discharge machining a hole through a portion of the carbide substrate and then by a laser through the diamond. A nozzle opening formed in the nozzle body may be directed into the surface at an acute angle with respect to the manifold. A nozzle opening formed in the nozzle body may be directed into the surface at an angle perpendicular to the surface. A portion of the nozzle body may extend forward of the nozzle opening and be adapted to prevent chipping of the paved surface.

DETAILED DESCRIPTION OF THE INVENTION AND THE PREFERRED EMBODIMENT

Figure 1:
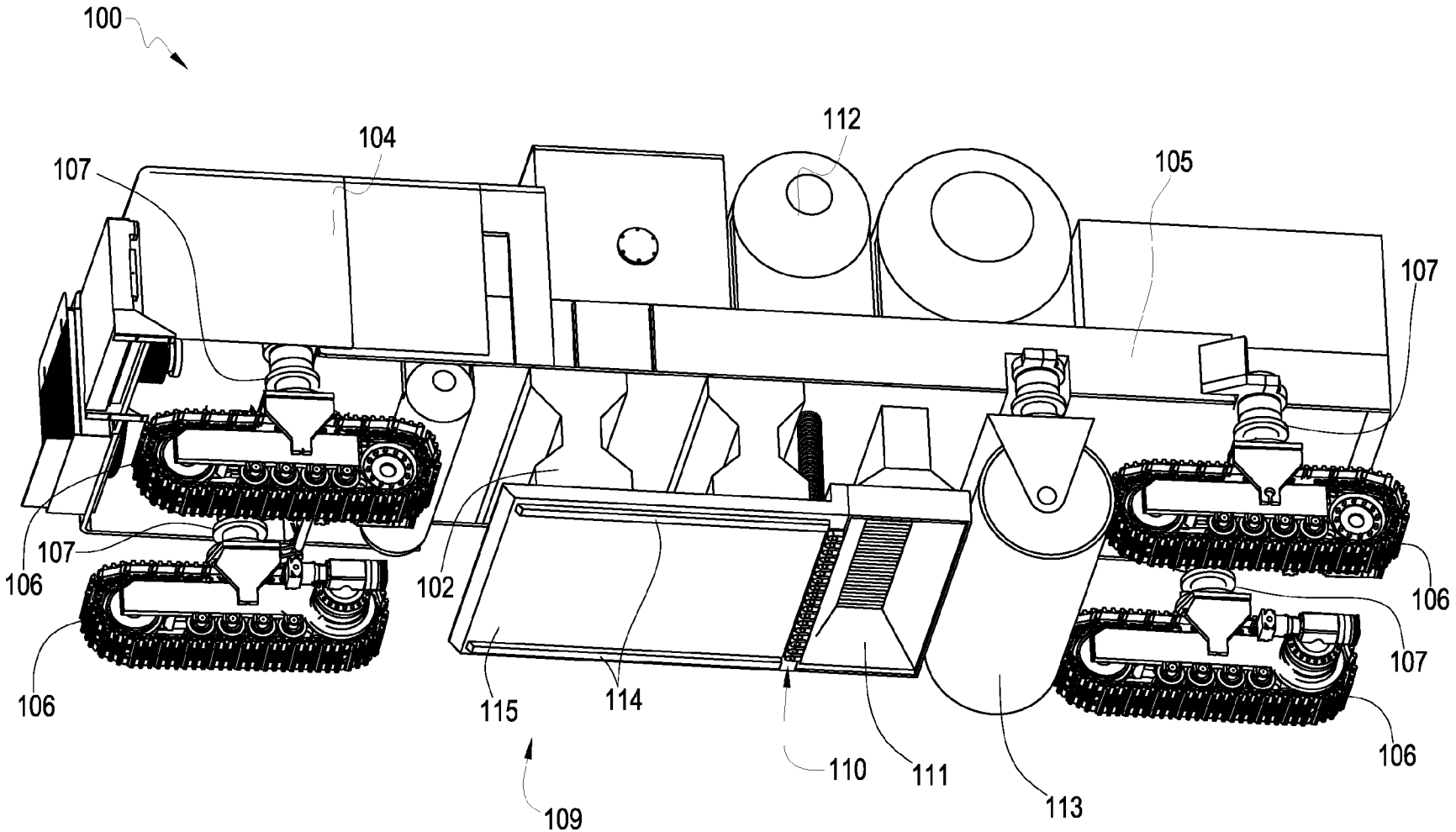
FIG. 1 is a perspective diagram of an embodiment of a pavement reconditioning machine.

Referring to the paved surface reconditioning machine in the embodiment of FIG. 1, a motorized vehicle 100 may include a shroud 104 covering various internal components of the motorized vehicle 100, a frame 105, and a translational element such as tracks 106, wheels, or the like, to translate or move the vehicle. The motorized vehicle 100 may also include a mechanism 107 for adjusting the elevation and slope of the frame relative to the translational element 106 to adjust for varying elevations, slopes, and contours of an underlying paved surface (see No. 203 in FIG. 2).

The vehicle comprises a manifold 109 beneath the frame 105 of the vehicle 100. The manifold 109 may be attached to the frame 105 by beams 102 such that the manifold 109 is pressed down against the paved surface when the machine is in operation. The manifold 109 may alternatively be attached to the frame 105 by an actuator which may adjust the vertical position of the manifold 109. The paved surface may be an asphalt surface, a concrete surface, or a paved surface comprising other constituents.

The manifold 109 comprises a plurality of high temperature, high pressure nozzles 110 disposed within the manifold adjacent the paved surface. A depressurization chamber 111 may be rearward of the nozzles 110. The nozzles 110 may emit a fluid under high temperature and high pressure onto the paved surface such that the paved surface swells. Pressurize in the paved surface may be maintained by a plate or the manifold itself pressing against the paved surface. The swelled paved surface may depressurize as the depressurization chamber 111 moves over the swelled paved surface. When the paved surface depressurizes, aggregate in the paved surface may separate from paved surface cement and a fresh coating of rejuvenation material is applied to the aggregate in the depressurization chamber. The vehicle 100 may comprise at least one container, such as a water or rejuvenation material storage tank, where one or more fluid reservoirs 112 are contained. The vehicle 100 may also comprise a compactor 113 rearward of the depressurization chamber. The compactor 113 compresses the depressurized paved surface back down into a new paved surface.

The manifold 109 may comprise one or more strips 114 which, when pressed firmly against the paved surface, act as seals to keep the heat and pressure underneath an area of an underside 115 of the manifold as the nozzles 110 pressurize the paved surface. The strips 114 may comprise a hard material such as tungsten carbide to prevent wear.

Figure 2:
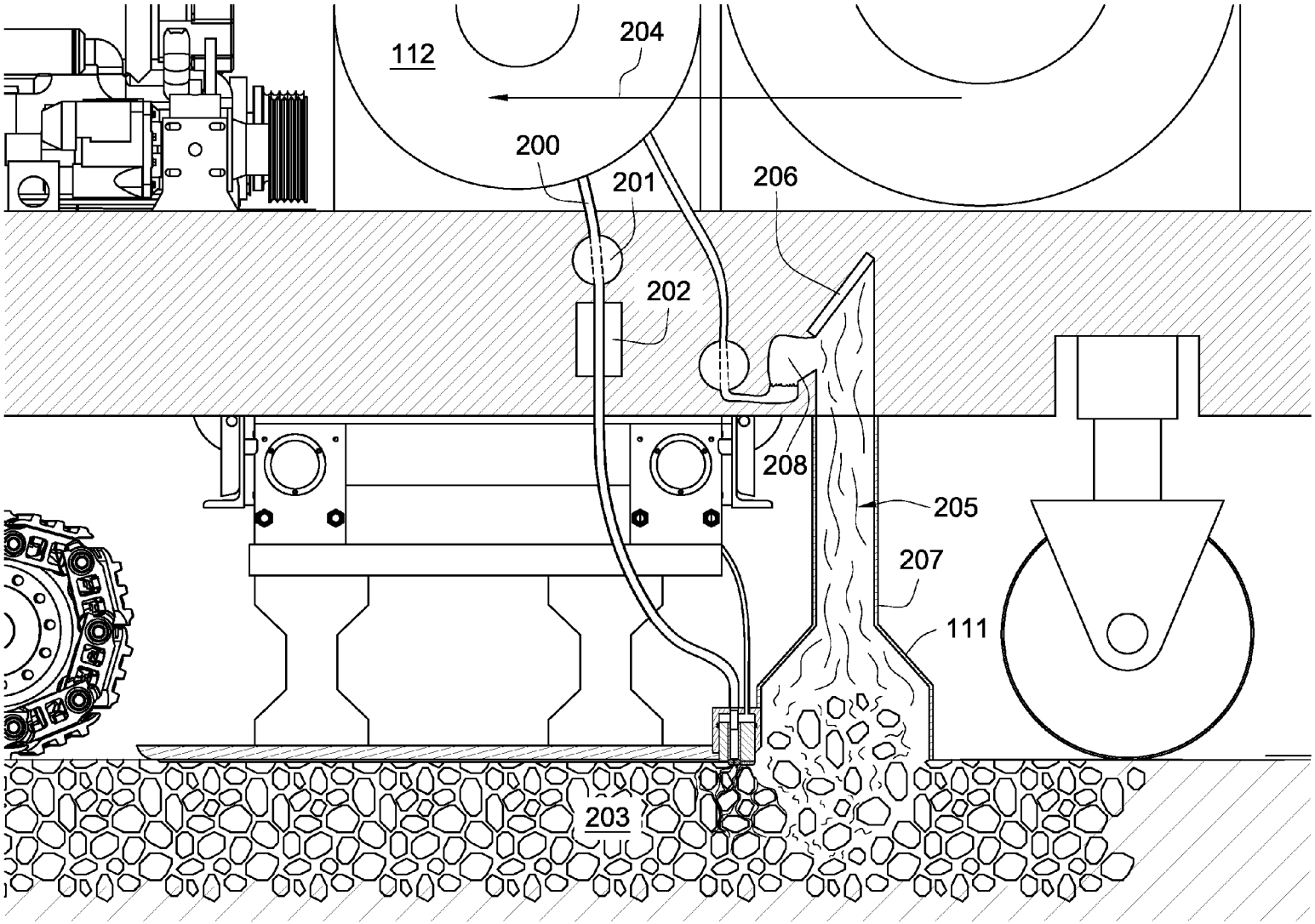
FIG. 2 is a cross-sectional diagram of another embodiment of a pavement reconditioning machine.

Referring now to FIG. 2, the nozzles 110 are in fluid communication with a fluid reservoir 112 through a fluid pathway 200. The fluid pathway 200 comprises a pressurization mechanism 201, such as a pump, and a heater 202 and/or heat exchanger which pressurize and heat the fluid to high pressure and high temperature in the pathway 200 before it reaches the nozzles 110. The emitted fluid exerts a force on the paved surface 203 in a downward and/or outward direction. The force on the paved surface 203 provided by the manifold 109 forces the emitted fluid into the paved surface where it is contained until the depressurization chamber 111 moves above it, when the pressure is released, causing the surface 203 to expand upward and separating the aggregate from the binder as the vehicle 100 moves in the direction indicated by the arrow 204.

The fluid emitted from the nozzles 110 may comprise water, oils, maltenes, asphaltenes, surfactants, zeolites, polymers, rubbers, waxes, foaming agents, or combinations thereof. When the paved surface depressurizes into the depressurization chamber 111, the fluid may be generally uniformly mixed among the aggregate. Also, because of the high temperature of the fluid, when the fluid reaches the depressurization chamber 111, some of the fluid may be evaporated and collected, which may then be sent back to the fluid reservoir for reuse. When the vapor 205 reaches a top 206 of a fume chute 207 attached to the depressurization chamber 111, the vapor condenses and pools in a separate chamber 208 which is then pumped back into the fluid reservoir 112. The top 206 of the fume chute 207 may be cooled to aid the condensation of the vapor.

Figure 3:
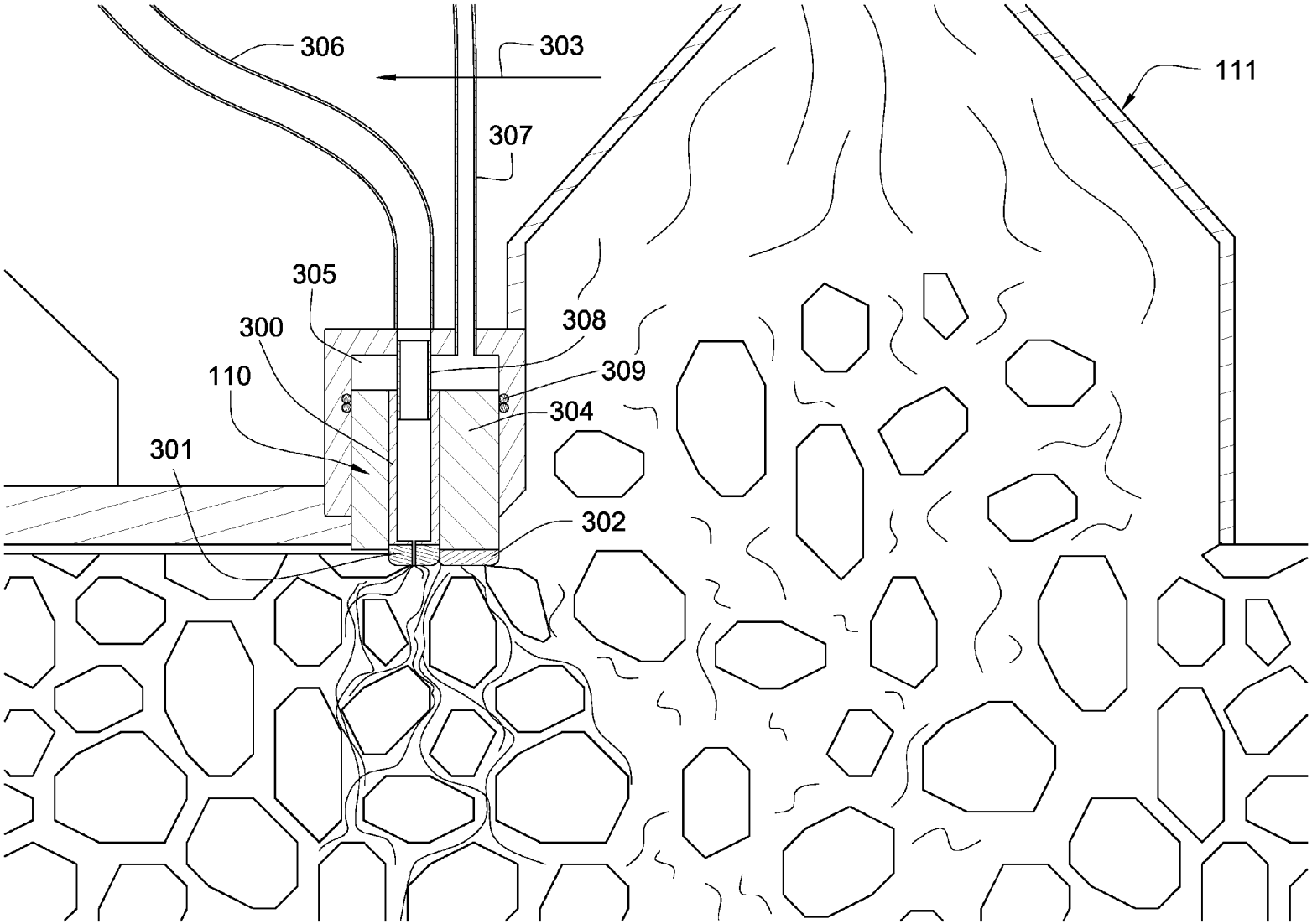
FIG. 3 is a cross-sectional diagram of an embodiment of a manifold

Referring to FIG. 3, a nozzle 110 is formed in a nozzle body 300 with a distal end 301 comprising a hard material with a hardness of at least 2,000 HK adapted to indent the paved surface 203 while the vehicle 100 moves in a direction indicated by the arrow 303. The paved surface reconditioning machine may comprise at least one projection 302 proximate and rearward of each nozzle 110 and forward of the depressurization chamber 111 and be adapted to maintain pressure on the pressurized surface. In some embodiments, the projections are formed in the nozzle body. Preferably, the nozzles 110 provide a continuous flow while traversing the paved surface such that the pressure in the paved surface is constantly high until it is released in the depressurization chamber. In some embodiments, the flow may be pulsed. Because the nozzles 110 are operating continuously at high pressure, the fluid may create grooves in the paved surface. In order to maintain the high pressure on the paved surface, the projections 302 may also be adapted to fit within the formed grooves and hold the pressure in the paved surface. The projections 302 may comprise a hard, wear-resistant material such as hardened steel, tungsten carbide, diamond, ceramics, or other wear-resistant materials.

The nozzle 110 may be vertically translatable to allow the nozzle 110 to apply varying amounts of force on the surface, depending on the desired depth of indentation. The nozzle 110 may be hydraulically translated. The nozzle 110 may be attached to a translatable element 304, which may be at least partially disposed within a hydraulic chamber 305. Hydraulic fluid may exert a downward force on the translatable element 304 as the paved surface exerts an upward force on the element 304. The downward force may be adjusted as desired by changing the amount of hydraulic fluid in the chamber 305.

Fluid may be carried to the nozzle 110 by a first fluid conduit 306, while the hydraulic fluid for translating the element vertically may be carried to the hydraulic chamber 305 by a second fluid conduit 307. An intermediate tube 308 may be disposed within the nozzle 110 and passing through the chamber 305, connecting the nozzle 110 to the first fluid conduit 306 and separating the hydraulic fluid from the nozzle fluid in the hydraulic chamber 305. The chamber 305 and/or nozzle 110 may comprise o-rings 309 or other sealing means to prevent mixing or leakage of the fluids.

Figure 4:
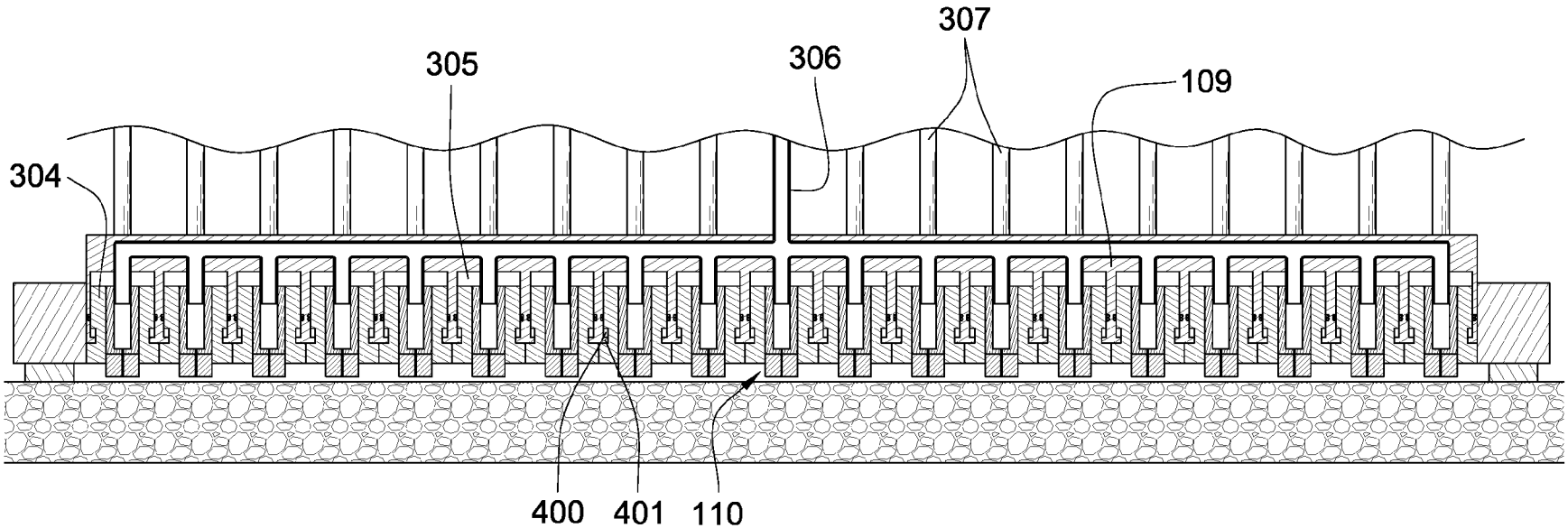
FIG. 4 is a cross-sectional diagram of another embodiment of a manifold.

A single fluid conduit 306 may be in fluid communication with all of the nozzles 110, as in the embodiment of FIG. 4. Each of the nozzles 110 may be disposed in individual translatable elements 304. Each of the elements 304 may be independently controlled by separate hydraulic fluid conduits 307, which may be advantageous while the vehicle traverses over uneven terrains. Each element 304 may comprise an inset portion 400 adapted to catch a lip 401 of the manifold 109 which may prevent the element from exiting the hydraulic chamber 305. Alternatively, the elements 304 may provide hydraulic fluid by a single hydraulic fluid conduit 307. Each nozzle 110 may alternatively be in fluid communication with individual fluid conduits 306.

The pavement reconditioning machine may comprise electronic equipment such as sensors, processors, logic circuits, controllers, or other electronic devices. The manifold 109 may be in electrical communication with the electronic equipment. The electronic equipment may monitor the temperature or pressure in the paved surface, the rate of flow of the fluid, or the pressure in the hydraulic chamber 305. This information may be used to control the speed of the vehicle, the amount of pressure in the chamber, or other components of the machine or reconditioning process.

Figure 5:
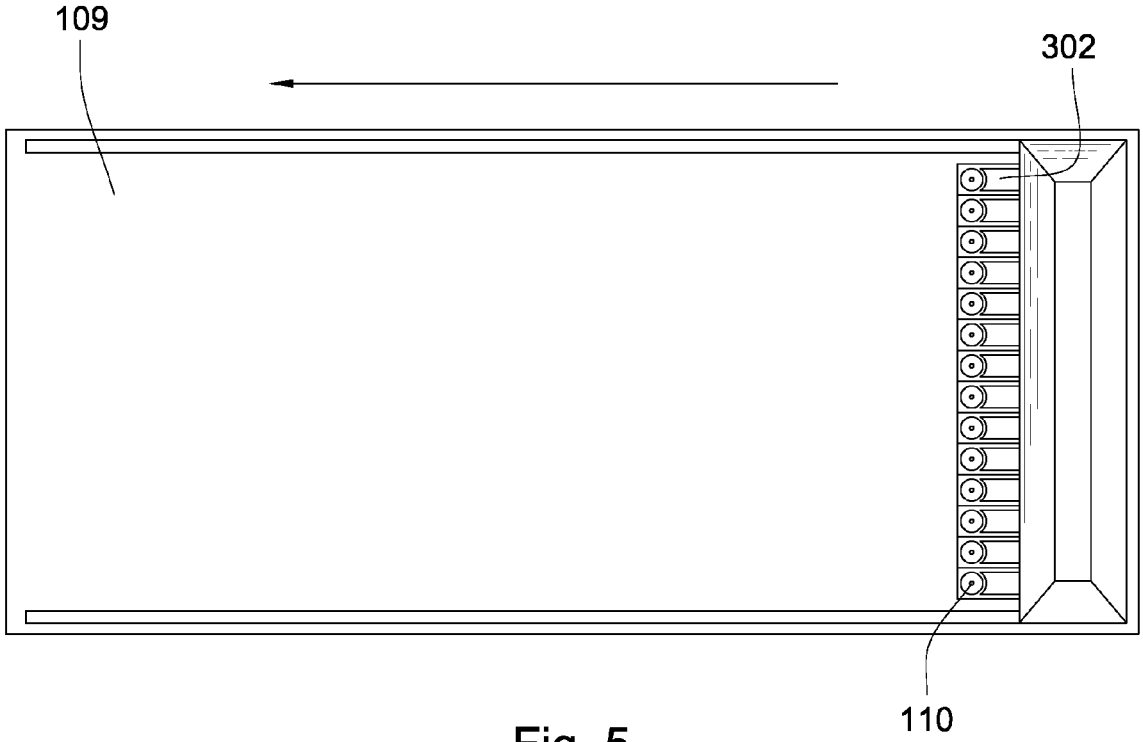
FIG. 5 is an orthogonal diagram of another embodiment of a manifold.
Figure 5A:
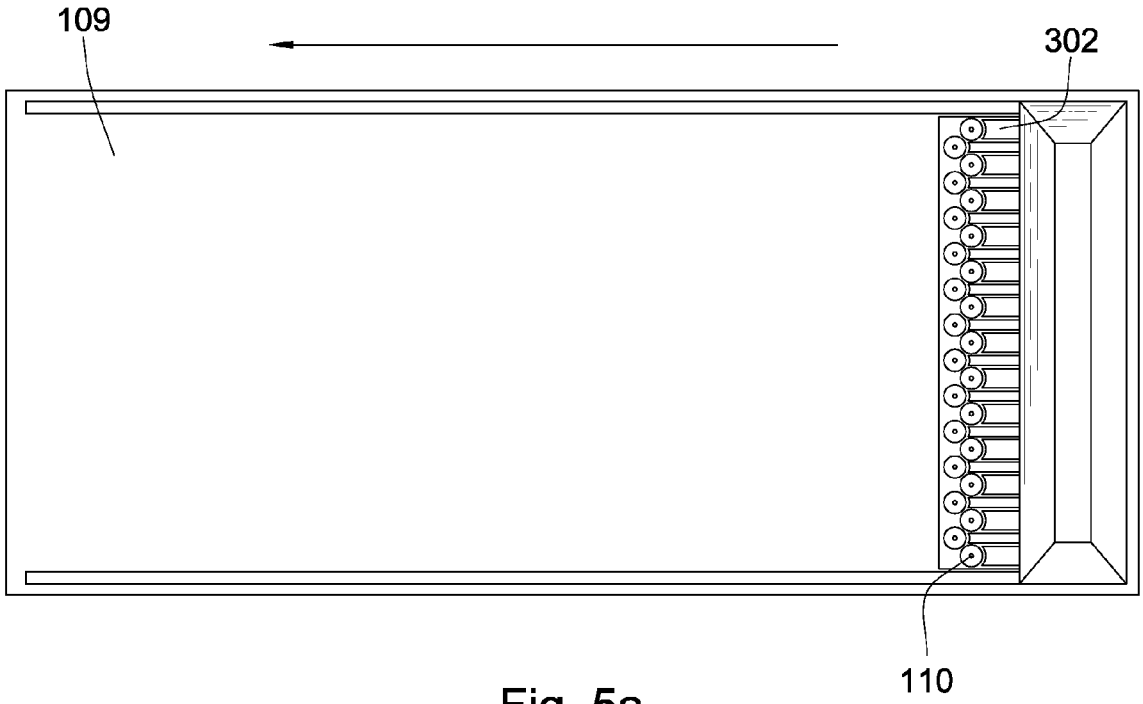

Referring to the embodiment of FIG. 5, the translatable elements 304 may be disposed within the manifold 109 immediately proximate one another. This may allow the nozzles 110 to be placed proximate each other such that a short distance exists between each nozzle 110. The projections 302 may be shaped and positioned such that no gap exists between the nozzle 110 and the projection 302.

Figure 6:
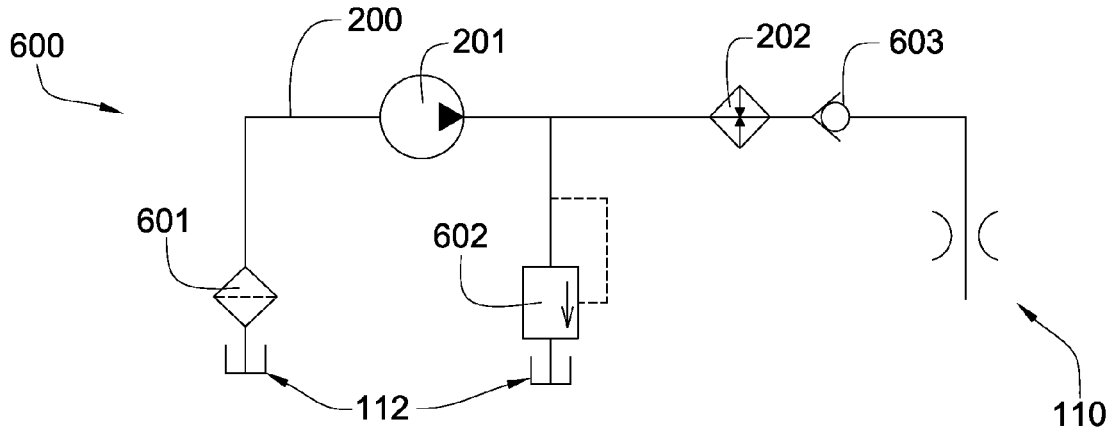
FIG. 6 is a schematic diagram of an embodiment of an asphalt reconditioning system.

A schematic diagram 600 of one embodiment of the asphalt reconditioning system is shown in FIG. 6, wherein a fluid reservoir 112 is in communication with a nozzle 110 through a fluid pathway 200. The system may comprise a single fluid reservoir 112, which may hold water for cleaning the paved surface. The fluid reservoir may be followed by a filter 601 to remove any impurities from the fluid to prevent buildup in the fluid pathway 200 and to prevent the impurities from getting into the paved surface. A pressurizing mechanism 201 designed to pressurize the fluid to a pressure up to 20,000 PSI may follow the filter 601. The system also comprises a heating mechanism 202 designed to heat the fluid to a temperature up to 500 F., which may follow the pump 201. An overflow system 602 may also be connected to the fluid pathway 200 between the pump 201 and the heater 202 in order to release any excess fluid pressure back to the fluid reservoir 112. The fluid pathway 200 may also comprise a check relief valve 603 which allows the fluid to pass through to the nozzle 110 at a certain amount of pressure and which maintains the rest of the fluid at a different pressure.

Figure 7:
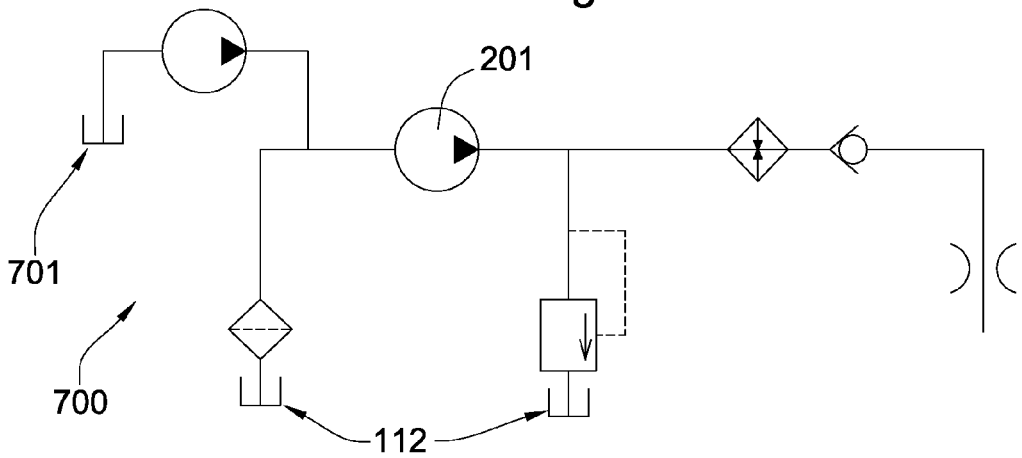
FIG. 7 is a schematic diagram of another embodiment of an asphalt reconditioning system.
Figure 8:
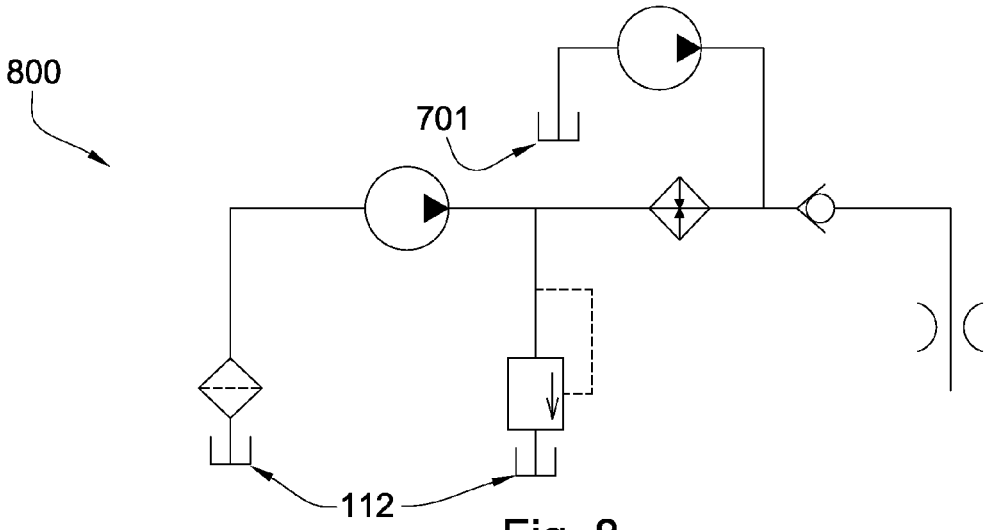
FIG. 8 is a schematic diagram of another embodiment of an asphalt reconditioning system.

FIG. 7 shows a schematic 700 of an embodiment of the pavement reconditioning system which comprises two fluid reservoirs 112, 701, one 112 which holds water and a second 701 which holds a rejuvenation material, wherein the fluid from the second reservoir 701 is pressurized before mixing with the water. The mixture then passes through a pressurization mechanism 201. FIG. 8 also shows a schematic 800 of a system which comprises two reservoirs 112, 701, wherein the rejuvenation material is mixed with the water after the water has been heated. The fluid reservoirs 112, 701, in either of the embodiments of FIGS. 6-8 may be in fluid communication with a plurality of nozzles.

Figure 9:
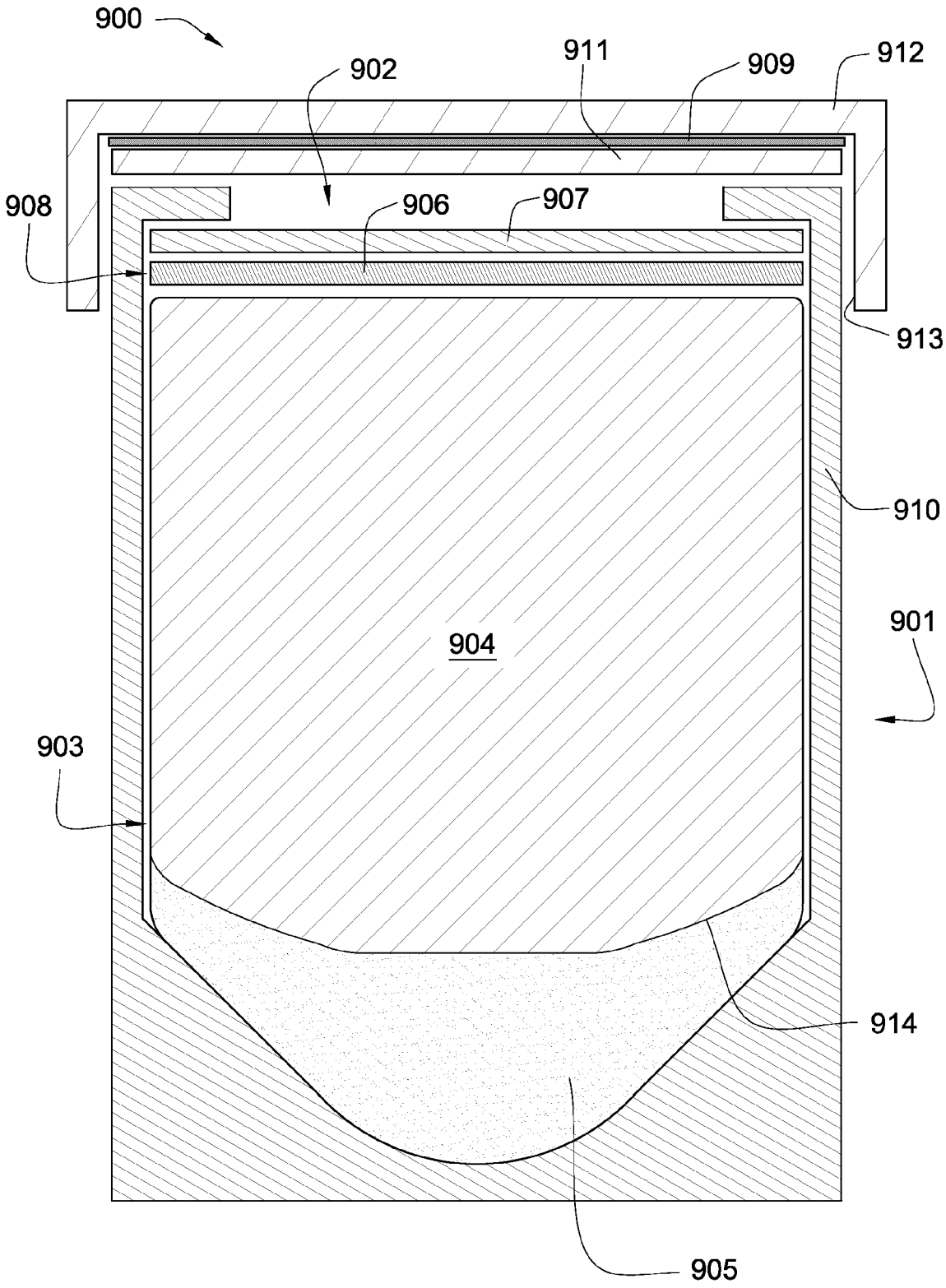
FIG. 9 is a cross-sectional diagram of an embodiment of an assembly for high pressure, high temperature processing.

FIG. 9 is a cross-sectional diagram of an embodiment of an assembly 900 for HPHT processing. The assembly comprises a can 901 with an opening 902 and a mixture 903 disposed therein. The mixture 903 may comprise a substrate 904 lying adjacent a hard material 905 in particle form. The hard material 905 may be selected from the group consisting of diamond, polycrystalline diamond, thermally stable products, polycrystalline diamond depleted of its catalyst, polycrystalline diamond having nonmetallic catalyst, cubic boron nitride, cubic boron nitride depleted of its catalyst, and combinations thereof. The substrate 904 may comprise a hard metal such as carbide, tungsten-carbide, or other cemented metal carbides. Preferably, the substrate 904 comprises a hardness of at least 58 HRc. Other possible materials may include hardened steel, hard facing, cubic boron nitride, and other ceramics and/or composites.

A stop off 906 may be placed within the opening 902 of the can 901 in-between the mixture 903 and a first lid 907. The stop off 906 may comprise a material selected from the group consisting of a stop off compound, a solder/braze stop, a mask, a tape, a plate, and sealant flow control, or a combination thereof. In one embodiment the stop off 906 may comprise a disk of material that corresponds with the opening of the can 901. A gap 908 between 0.005 to 0.050 inches may exist between the stop off 906 and the can 901. The gap 908 may support the outflow of contamination while being small enough size to prevent the flow of a sealant 909 into the mixture 903. In some embodiments, the sealant may be copper. Various alterations of the current configuration may include but should not be limited to; applying a stop off 906 to the first lid 907 or can by coating, etching, brushing, dipping, spraying, silk screening painting, plating, baking, and chemical or physical vapor deposition techniques. The stop off 906 may in one embodiment be placed on any part of the assembly where it may be desirable to inhibit the flow of the liquefied sealant.

The first lid 907 may comprise niobium or a niobium alloy to provide a substrate 904 that allows good capillary movement of the sealant 909. After the first lid 907 the walls 910 of the can may be folded over the first lid 907. A second lid 911 may then be placed on top of the folded walls 910. The second lid 911 may comprise a material selected from the group consisting of a metal or metal alloy. The metal may provide a better boding surface for the sealant 909 and allow for a strong bond between the lids 907, 911, can 901, and a cap 912. Following the second lid 911 a metal or metal alloy cap 912 may be place on the can. In one embodiment the cap 912 may comprise a smooth surface finish 913 to provide a better bonding surface for the sealant 909. This assembly 900 may then allow the substrate 904 and hard material 905 to be placed under high temperature and high pressure such that the hard material 905 is bonded to the substrate 904.

An interface 914 between the substrate 904 and the hard material 905 may be flat, rounded, sloped, angled, or any combination thereof. The interface 914 may also comprise dimples, bumps, ridges, or surface deformities adapted to provide more surface area for the hard material to be bonded to, which may provide a stronger bond.

Referring now to the embodiments of FIGS. 10 through 18, the nozzle 110 may be formed by electric discharge machining a hole 1000 through a portion of the substrate 904 and then forming a smaller hole 1001 through the hard material 905 with a laser, which may help increase the velocity with which the fluid exits the nozzle 110. The laser may also be used to cut into a portion of the substrate 904 in order to connect the hole 1001 in the hard material 905 with the larger hole 1000 in the substrate 904 formed by the electric discharge machine (EDM).

Figure 10:
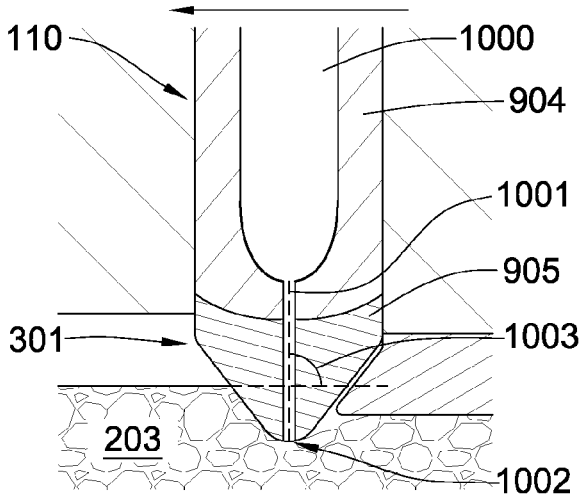
FIG. 10 is a cross-sectional diagram of an embodiment of a nozzle.
Figure 11:
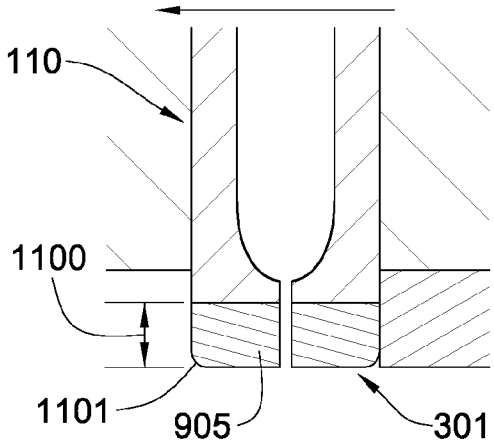
FIG. 11 is a cross-sectional diagram of another embodiment of a nozzle.
Figure 12:
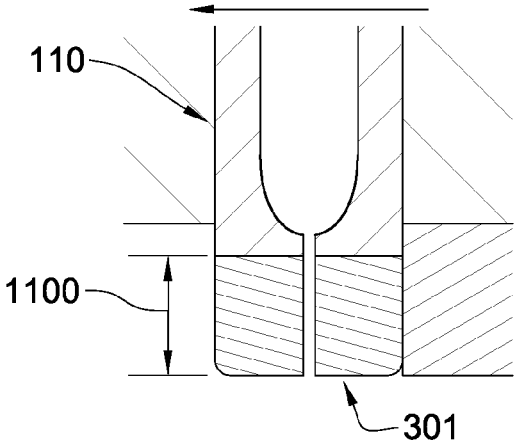
FIG. 12 is a cross-sectional diagram of another embodiment of a nozzle.
Figure 13:
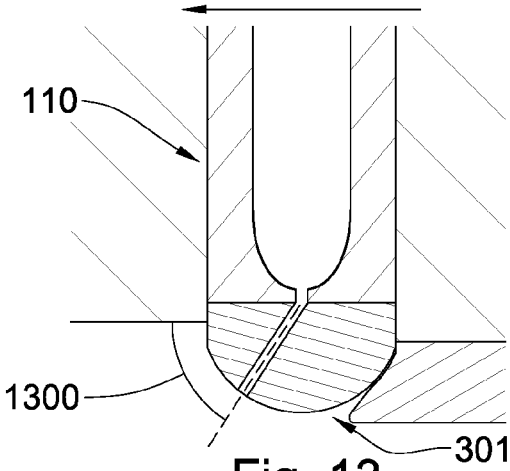
FIG. 13 is a cross-sectional diagram of another embodiment of a nozzle.
Figure 14:
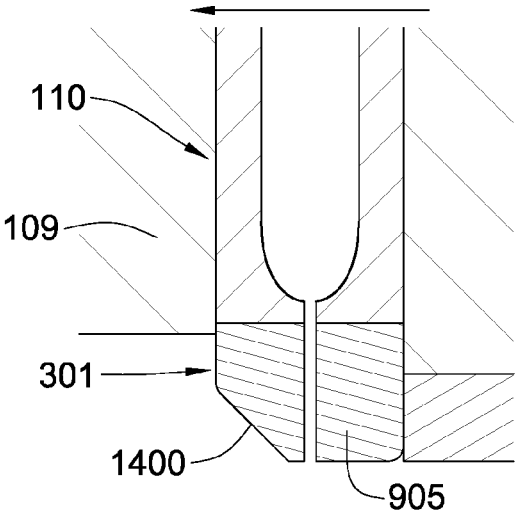
FIG. 14 is a cross-sectional diagram of another embodiment of a nozzle.
Figure 15:
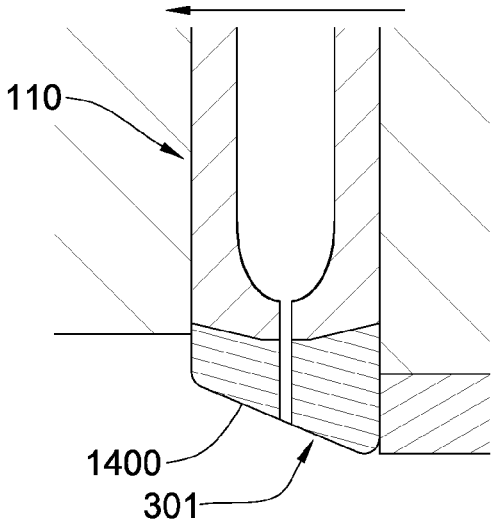
FIG. 15 is a cross-sectional diagram of another embodiment of a nozzle.

The distal end 301 of the nozzle 110 may be pointed, as in the embodiment of FIG. 10. The pointed end may distribute the load on the nozzle 110 as the vehicle moves across the paved surface, which may improve the working life of the nozzle. The nozzle 110 may comprise an opening 1002 which may be directed into the surface at an angle 1003 perpendicular to the paved surface. The distal end 301 may be flat, as in the embodiments of FIGS. 11 and 12, such that the pressure on the surface is equally maintained as the vehicle moves. A thickness 1100 of the hard material 905 may preferably be at least 0.100 inch. The thickness 1100 may also be up to 1 inch.

The distal end may also comprise a radiused forward edge 1100, which may more evenly distribute the load forces throughout the distal end 301. The distal end 301 may be rounded, as in the embodiment of FIG. 13, and the nozzle opening 1002 may be directed into the surface at an acute angle 1300 with respect to the manifold 109. The distal end 301 may be polygonal, as in the embodiment of FIG. 14, or sloped, as in the embodiment of FIG. 15, wherein the end 301 comprises an angled portion 1400 adapted to contact the surface. This may help distribute the forces on the distal end 301 in order to reduce wear on the nozzle 110. The projection 302 may also be rounded, sloped, angled or it may abut the distal end 301 of the nozzle 110, depending on the amount of pressure desired in the indented portion of the surface.

Figure 16:
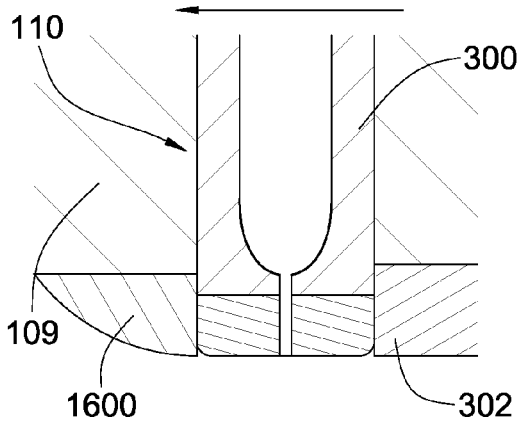
FIG. 16 is a cross-sectional diagram of another embodiment of a nozzle.
Figure 17:
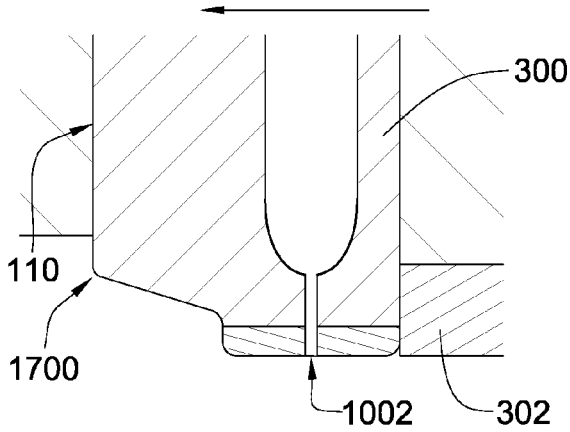
FIG. 17 is a cross-sectional diagram of another embodiment of a nozzle.
Figure 18:
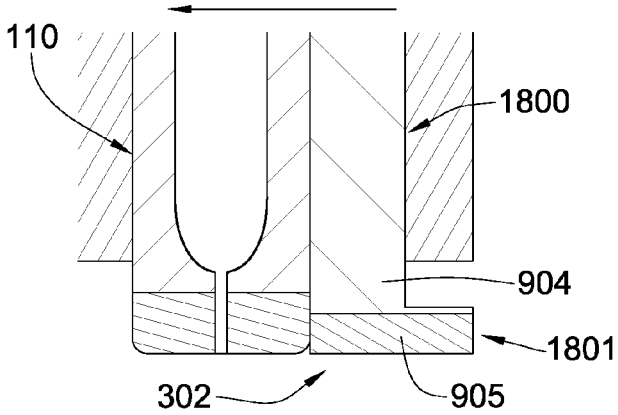
FIG. 18 is a cross-sectional diagram of another embodiment of a nozzle.

The manifold 109 may further comprise a projection 1600 proximate and forward of the nozzle body 300, as in the embodiment of FIG. 16, the projection 1600 being adapted to prevent chipping of the paved surface, which may be due to the fluid pressure or the angle at which the fluid enters the surface. The nozzle body 300 may alternatively comprise a portion 1700 which extends forward of the nozzle opening 1002 and is adapted to help prevent chipping of the paved surface, as in the embodiment of FIG. 17. The projections 302, 1600, either rearward of the nozzle, as in the embodiment of FIG. 18, or forward of the nozzle, may comprise a hard material 905 bonded to a substrate 904. The projection 302 may be independently translatable, such that the projection 302 may apply a variable amount of pressure to the surface. A portion of a body 1800 of the projection 302 may be narrower than a distal end 1801 of the projection 302, allowing the projection 302 to apply continuous pressure from the nozzle 110 to the depressurization chamber 111.

Figure 19:
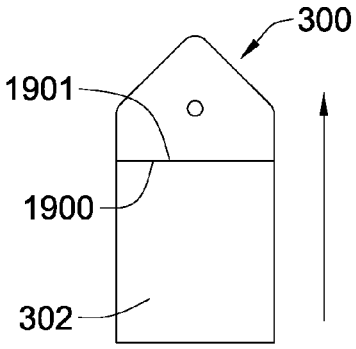
FIG. 19 is an orthogonal diagram of an embodiment of a protrusion rearward of a nozzle.
Figure 20:
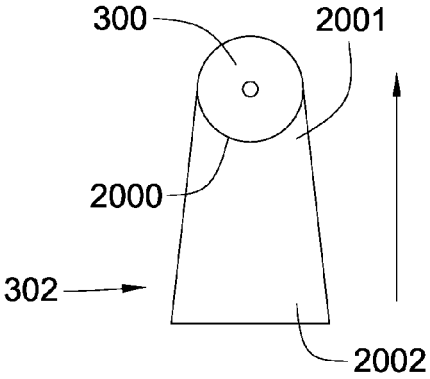
FIG. 20 is an orthogonal diagram of another embodiment of a protrusion rearward of a nozzle.
Figure 21:
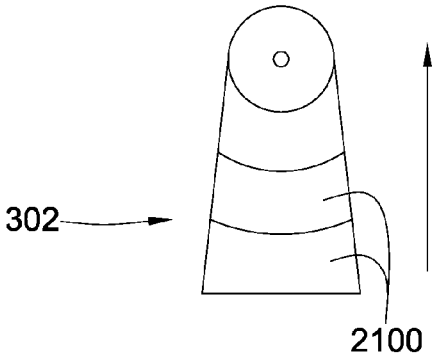
FIG. 21 is an orthogonal diagram of another embodiment of a protrusion rearward of a nozzle.

The nozzle body 300 may comprise a wedge shape, as in the embodiment of FIG. 19. The nozzle body 300 may also be shaped using an EDM such that a flat portion 1900 of the nozzle body 300 abuts a flat portion 1901 of the projection 302. The nozzle body 300 may be round, while the projection 302 comprises a portion 2000 adapted to fit the curvature of the nozzle body 300, as in the embodiment of FIG. 20. The projection 302 may also comprise a narrow front portion 2001 and a wide rear portion 2002 such that the projection 302 applies more pressure to the indented surface as the vehicle moves in a forward direction. The projection 302 may comprise a segmented hard material 2100, as in the embodiment of FIG. 21, since the hard material may be easier to bond to a substrate in small portions and may then be cut into a desired shape using an EDM.

Whereas the present invention has been described in particular relation to the drawings attached hereto, it should be understood that other and further modifications apart from those shown or suggested herein, may be made within the scope and spirit of the present invention.

What is claimed is:

1. An apparatus for reconditioning a paved surface, comprising:

a vehicle adapted to traverse the paved surface;

the vehicle comprising a manifold with a plurality of high temperature, high pressure nozzles adapted to indent the paved surface;

at least one nozzle comprising a nozzle body with a distal end comprising a hard material with a hardness of at least 2,000 HK;

the at least one nozzle is also in fluid communication with a fluid reservoir through a fluid pathway;

the apparatus comprising a pressurizing mechanism and a heating mechanism for pressurizing and heating fluid in the fluid pathway, a depressurization chamber rearward of the at least one nozzle; and a compactor rearward of the depressurization chamber.

2. The apparatus of claim 1, wherein the hard material is selected from the group consisting of diamond, monocrystalline diamond, polycrystalline diamond, sintered diamond, chemical deposited diamond, physically deposited diamond, natural diamond, infiltrated diamond, layered diamond, thermally stable diamond, silicon bonded diamond, metal bonded diamond, cubic boron nitride, silicon carbide, diamond impregnated matrix, diamond impregnated carbide, and combinations thereof.

3. The apparatus of claim 1, wherein the nozzle body is vertically translatable.

4. The apparatus of claim 3, wherein the nozzle body is hydraulically translated.

5. The apparatus of claim 1, wherein the manifold is in electrical communication with electronic equipment.

6. The apparatus of claim 1, wherein the manifold further comprises a projection proximate and rearward of the at least one nozzle body, the projection being adapted to maintain pressure on the paved surface.

7. The apparatus of claim 6, wherein the projection comprises a plurality of diamond segments.

8. The apparatus of claim 1, wherein the distal end is pointed, rounded, flat, polygonal, or any combination thereof.

9. The apparatus of claim 1, wherein a nozzle opening formed in the nozzle body is directed into the surface at an acute angle with respect to the manifold.

10. The apparatus of claim 1, wherein a nozzle opening formed in the nozzle body is directed into the surface at an angle perpendicular to the surface.

11. The apparatus of claim 1, wherein the distal end comprises a sloped face adapted to contact the surface.

12. The apparatus of claim 1, wherein the nozzle body comprises a wedge shape with a wider portion of the wedge shape rearward of a narrower portion of the wedge shape.

13. The apparatus of claim 1, wherein the nozzle body comprises a radiused forward edge on the distal end.

14. The apparatus of claim 1, wherein the nozzle body is adapted to indent up to an inch into the paved surface.

15. The apparatus of claim 1, wherein the nozzle body is formed from a carbide substrate bonded to diamond.

16. The apparatus of claim 15, wherein the nozzle is formed by electric discharge machining a hole through a portion of the carbide substrate and then by a laser through the diamond.

17. The apparatus of claim 15, wherein the diamond comprises a thickness of at least 0.100 inch.

18. The apparatus of claim 1, wherein the manifold further comprises a projection proximate and forward of the nozzle body, the projection being adapted to prevent chipping of the paved surface.

19. The apparatus of claim 1, wherein a portion of the nozzle body extends forward of the nozzle opening and is adapted to prevent chipping of the paved surface.

* * * * *